US010260526B2

(12) United States Patent
Hayashida et al.

(10) Patent No.: US 10,260,526 B2
(45) Date of Patent: Apr. 16, 2019

(54) AXIAL FAN AND FAN ASSEMBLY

(71) Applicant: Nidec Corporation, Minami-ku, Kyoto (JP)

(72) Inventors: Ryota Hayashida, Kyoto (JP); Tsukasa Takaoka, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 15/920,551

(22) Filed: Mar. 14, 2018

(65) Prior Publication Data

US 2018/0202462 A1 Jul. 19, 2018

Related U.S. Application Data

(63) Continuation of application No. 14/754,928, filed on Jun. 30, 2015, now Pat. No. 9,964,123.

(30) Foreign Application Priority Data

Aug. 6, 2014 (JP) ..... 2014-159987
Mar. 6, 2015 (JP) ..... 2015-044161

(51) Int. Cl.
*F04D 19/00* (2006.01)
*F04D 25/06* (2006.01)
(Continued)

(52) U.S. Cl.
CPC ..... *F04D 29/662* (2013.01); *F04D 19/007* (2013.01); *F04D 25/064* (2013.01);
(Continued)

(58) Field of Classification Search
CPC .... F04D 29/662; F04D 19/007; F04D 19/024; F04D 25/664; F04D 25/0646; F04D 29/26; F04D 29/403
See application file for complete search history.

(56) References Cited

U.S. PATENT DOCUMENTS 4,909,711 A * 3/1990 Burgbacher ..... F04D 25/08 415/218.1
2008/0101920 A1* 5/2008 Yoshida ..... F04D 25/0613 415/68
2013/0121859 A1* 5/2013 Hirono ..... F04D 25/062 417/423.13

OTHER PUBLICATIONS

Hayashida et al., "Axial Fan Having Balance Correction Portions and a Cone Located Axial of One of the Balance Correction Portions", U.S. Appl. No. 14/754,928, filed Jun. 30, 2015.
(Continued)

*Primary Examiner* — Bryan M Lettman
*Assistant Examiner* — Timothy P Solak
(74) *Attorney, Agent, or Firm* — Keating & Bennett, LLP

(57) ABSTRACT

An impeller of an axial fan includes a cup-shaped blade support portion configured to cover a rotor holder, and blades in a circumferential direction outside of the blade support portion. Rotation of the impeller generates a downward air flow from the inlet of the axial fan to the outlet of the axial fan. The axial fan includes first and second balance correction portions. The first balance correction portion is located between the blade support portion and the rotor holder. The second balance correction portion is located axially below the first balance correction portion, and is located axially below the rotor holder and a junction of each blade with the blade support portion. The impeller includes a first cone portion located axially below the second balance correction portion. A tangent to a radially outer surface of the first cone portion crosses the second balance correction portion.

13 Claims, 5 Drawing Sheets

(51) Int. Cl.

| | |
|---|---|
| ***F04D 29/32*** | (2006.01) |
| ***F04D 29/54*** | (2006.01) |
| ***F04D 29/66*** | (2006.01) |
| ***F04D 29/68*** | (2006.01) |

(52) U.S. Cl.
CPC ..... *F04D 25/0646* (2013.01); *F04D 29/329* (2013.01); *F04D 29/545* (2013.01); *F04D 29/681* (2013.01)

(56) References Cited

OTHER PUBLICATIONS

Hayashida et al., "Axial Fan and Fan Assembly", U.S. Appl. No. 15/920,556, filed Mar. 14, 2018.

* cited by examiner

AXIAL FAN AND FAN ASSEMBLY

BACKGROUND OF THE INVENTION

1. Field of the Invention

The present invention relates to an axial fan and a fan assembly.

2. Description of the Related Art

A recent innovation in motor technology has improved efficiency of axial fans (or a reduction in power consumption of the axial fans). Moreover, to further improve the efficiency of the axial fans, various techniques have been contrived concerning the shape of blades. JP-A 2000-110772, for example, describes a fan in which a motor is supported on an outlet side. In the fan described in JP-A 2000-110772, a housing, which is located radially outside of an impeller to surround the impeller, and a motor support portion, which is configured to support the motor, are joined to each other by support ribs arranged on the outlet side of the impeller.

When each of the support ribs arranged on the outlet side of the impeller is structured in the shape of a blade called a stationary vane, an air flow caused by rotation of the impeller can be controlled by the support ribs. This contributes to reducing the likelihood that an eddy will occur in the air flow sent from the impeller. The impeller is configured to generate the air flow through the rotation thereof, and if the air flow is a laminar flow, only a small windage loss will occur, whereas if the air flow is a turbulent flow (i.e., if an eddy occurs), a large windage loss will occur. Therefore, when the support ribs are arranged to function as stationary vanes to reduce the likelihood that an eddy will occur, an increase in efficiency of the fan is achieved.

However, in the case of an axial fan in which support ribs (or stationary vanes) are arranged on an inlet side of an impeller, a contrivance in the shape of the support ribs could not be expected to produce a flow control effect on an air flow on an outlet side of the impeller. Therefore, in the case of the axial fan in which the support ribs are arranged on the inlet side of the impeller, a method other than the above method of allowing the support ribs to function as the stationary vanes is required to achieve a reduction in the windage loss.

SUMMARY OF THE INVENTION

An axial fan according to a preferred embodiment of the present invention includes a stationary portion and a rotating portion supported to be rotatable with respect to the stationary portion. The rotating portion includes a shaft positioned along a central axis extending in a vertical direction; a rotor magnet provided in an annular shape around the central axis; a rotor holder including a cylindrical inside surface configured to hold the rotor magnet; and an impeller directly or indirectly fixed to an outer circumferential surface of the rotor holder. The stationary portion includes an armature located radially inside of the rotor magnet; a bearing member configured to rotatably support the shaft; a base portion configured to support the bearing member and the armature; a tubular housing extending in an axial direction radially outside of the impeller; and a plurality of support ribs each of which is configured to join the housing and the base portion to each other, and is located upstream of the impeller in the axial direction. The impeller includes a cup-shaped blade support portion configured to cover the rotor holder, and a plurality of blades arranged in a circumferential direction radially outside of the blade support portion to generate a downward air flow from the inlet of the axial fan to the outlet of the axial fan during rotation. The rotating portion includes a first balance correction portion located between the blade support portion and the rotor holder, and configured to allow a change in a circumferential mass distribution. The impeller includes a second balance correction portion and a first cone portion. The second balance correction portion is located axially below the first balance correction portion, is located axially below the rotor holder and a junction of each blade with the blade support portion, and is configured to allow a change in a circumferential mass distribution. The first cone portion is located axially below the second balance correction portion, and decreases in diameter with a height decreasing downward in the axial direction. A tangent to a radially outer surface of the first cone portion crosses the second balance correction portion.

Preferred embodiments of the present invention provide axial fans that achieve significantly reduced windage loss and facilitate a balance correction to be carried out therein.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the accompanying drawings. It is assumed herein that a direction parallel or substantially parallel to a central axis of an axial fan is referred to by the term "axial direction", "axial", or "axially", that directions perpendicular or substantially perpendicular to the central axis of the axial fan are each referred to by the term "radial direction", "radial", or "radially", and that a direction along a circular arc centered on the central axis of the axial fan is referred to by the term "circumferential direction", "circumferential", or "circumferentially". It is also assumed herein that, with respect to an axial direction, an upper side in FIG. 1, from which air is taken in, will be referred to as an "inlet side" or simply as an "upper side", and a lower side in FIG. 1, toward which the air is discharged, will be referred to as an "outlet side" or simply as a "lower side". Note that the above definitions of the "upper side" and the "lower side" are made simply for the sake of convenience in description, and have no relation to the direction of gravity. Axial fans according to preferred embodiments of the present invention may be used in any orientation.

Figure 1:
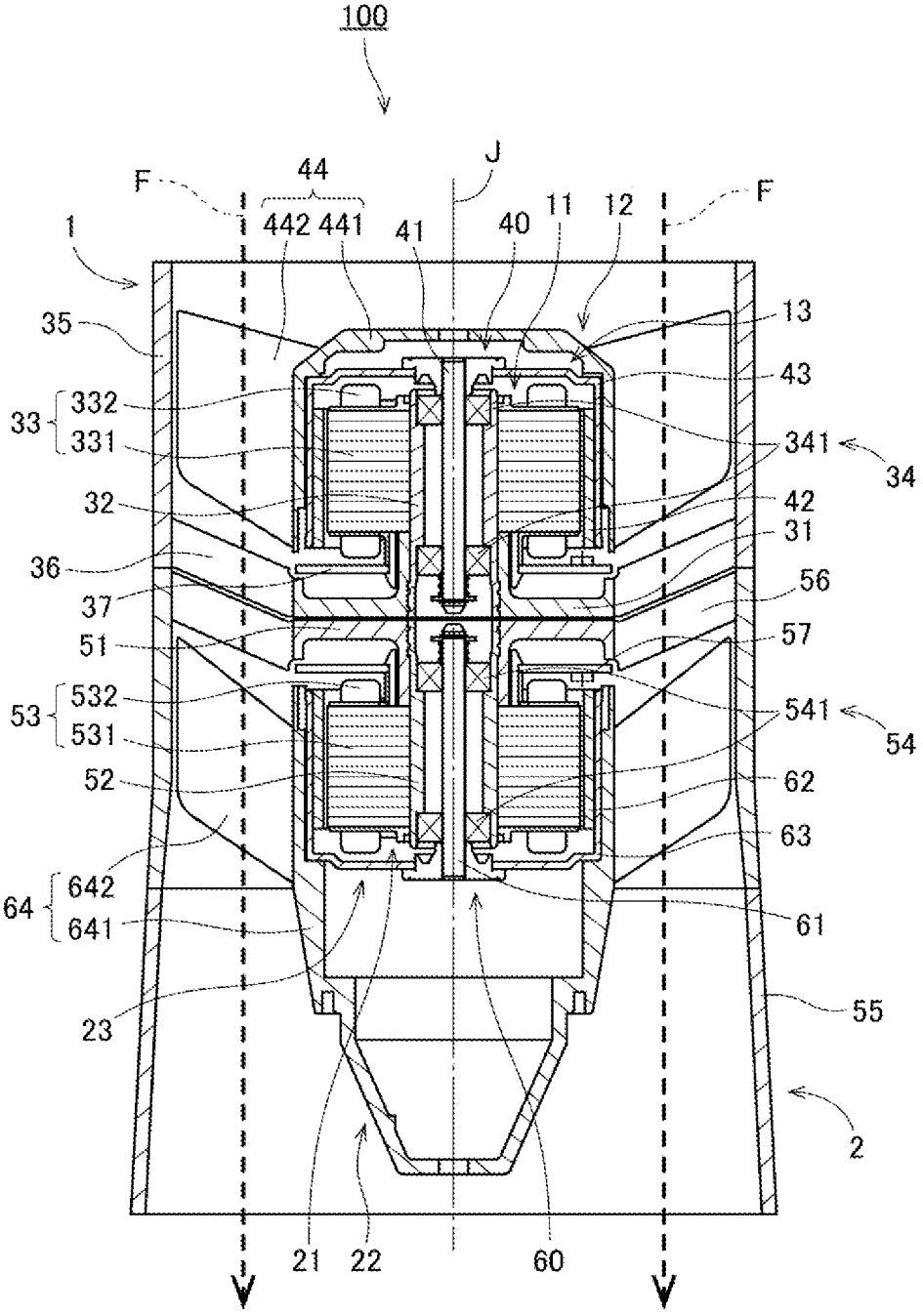
FIG. 1 is a cross-sectional view of a fan assembly according to a preferred embodiment of the present invention.

FIG. 1 is a vertical cross-sectional view of a fan assembly 100 according to a preferred embodiment of the present invention taken along a plane including a central axis J. The fan assembly 100 is an apparatus which can be used to supply a cooling air flow to an interior of a room, such as, for example, a server room, in which a plurality of electronic devices are installed. A user may use either only the single fan assembly 100 or a plurality of fan assemblies 100 in combination. For example, a plurality of fan assemblies 100 may be installed in a single server room, and these fan assemblies 100 may be driven simultaneously.

Referring to FIG. 1, the fan assembly 100 includes an inlet side fan 1 and an outlet side fan 2. Each of the inlet side fan 1 and the outlet side fan 2 is an axial fan configured to generate a downward air flow along the central axis J. The inlet side fan 1 is located axially above the outlet side fan 2. Once the inlet side fan 1 and the outlet side fan 2 are driven, air is taken in from above the inlet side fan 1, and the air is sent downwardly of the outlet side fan 2. A downward air flow F along the central axis J is thus generated as indicated by a broken line arrow in FIG. 1.

The inlet side fan 1 includes a first stationary portion 11 and a first rotating portion 12. The first rotating portion 12 is supported to be rotatable with respect to the first stationary portion 11.

The first stationary portion 11 preferably includes a first base portion 31, a first bearing holding portion 32, a first armature 33, a first bearing member 34, a first housing 35, a plurality of first support ribs 36, and a first circuit board 37.

The first base portion 31 is located in the vicinity of a boundary between the inlet side fan 1 and the outlet side fan 2. A lower surface of the first base portion 31 is in contact with an upper surface of a second base portion 51 described below, or is arranged opposite to the upper surface of the second base portion 51 with a slight gap intervening therebetween. The first bearing holding portion 32 extends along the central axis J to assume or substantially assume the shape of a cylinder. A lower end portion of the first bearing holding portion 32 is fixed to the first base portion 31. The first base portion 31 is configured to support the first bearing member 34 and the first armature 33.

The first armature 33 is located radially inside of a first rotor magnet 42 described below. The first armature 33 preferably includes a stator core 331 and a plurality of coils 332. The stator core 331 is preferably defined by, for example, laminated steel sheets, each of which is a magnetic body. The stator core 331 is fixed to an outer circumferential surface of the first bearing holding portion 32. In addition, the stator core 331 preferably includes a plurality of teeth projecting radially outward. A radially outer end surface of each of the teeth is located radially opposite to a radially inner surface of the first rotor magnet 42 described below. Each of the coils 332 is preferably defined by a conducting wire wound around a corresponding one of the teeth.

The first bearing member 34 is accommodated radially inside of the first bearing holding portion 32. A pair of ball bearings 341, for example, are preferably used as the first bearing member 34. The ball bearings 341 are arranged one above the other along the central axis J. An outer race of each of the ball bearings 341 is fixed to an inner circumferential surface of the first bearing holding portion 32. An inner race of each of the ball bearings 341 is fixed to a first shaft 41 described below. The first shaft 41 is thus supported to be rotatable with respect to the first bearing holding portion 32.

The first housing 35 extends in the axial direction to assume the shape of a tube radially outside of a first impeller 44 described below. That is, the first housing 35 is provided in an annular shape radially outside of the first impeller 44 to surround the first impeller 44. A space radially inside of the first housing 35 defines a wind channel through which the air flow F passes. An upper opening of the first housing 35 defines an air inlet through which the air is taken in.

The first support ribs 36 are located below the first impeller 44 described below. Each of the first support ribs 36 extends in a radial direction to join the first base portion 31 and the first housing 35 to each other. A position of the first armature 33 relative to the first housing 35 is thus fixed. The number of first support ribs 36 is preferably, for example, three. The first base portion 31, the first housing 35, and the first support ribs 36 are, for example, integrally defined as portions of a single monolithic member through a resin injection molding process. Note, however, that some of the first support ribs 36, the first base portion 31, and the first housing 35 may be defined by separate members.

The first circuit board 37 is located above the first base portion 31 and below the first armature 33. The first circuit board 37 is preferably, for example, fixed to the first armature 33. The first circuit board 37 may be in the shape of either a ring or a circular arc in a plan view. The first circuit board 37 includes an electrical circuit to be electrically connected to the coils 332 of the first armature 33 to supply electric drive currents to the coils 332. This electrical circuit is connected to an external power supply disposed outside of the inlet side fan 1 through a bundle of lead wires. Note that the bundle of lead wires and the external power supply are not shown in the figures.

The first rotating portion 12 preferably includes the first shaft 41, the first rotor magnet 42, a first rotor holder 43, and the first impeller 44.

The first shaft 41 is located radially inside of the first bearing holding portion 32 to be coaxial or substantially coaxial with the central axis J. In other words, the first shaft extends along the central axis J extending in a vertical direction. The first shaft 41 extends downward from a center of an upper portion of the first rotor holder 43 described below. As mentioned above, the first shaft 41 is rotatably supported by the first bearing member 34. A lower end portion of the first shaft 41 is located radially inside of the first base portion 31. An upper end portion of the first shaft 41 projects upward above an upper end portion of the first bearing holding portion 32.

The first rotor magnet 42 preferably is annular, and is located radially outside of the first armature 33. In other words, the first rotor magnet 42 is provided in an annular shape around the central axis J. Note that the first rotor magnet 42 may be defined either by a single cylindrical magnet or by a plurality of magnets provided in an annular shape. The radially inner surface of the first rotor magnet 42 includes north and south poles arranged to alternate with each other in a circumferential direction.

The first rotor holder 43 is provided in the shape of a cup with an axially downward opening (or substantially in the shape of a covered cylinder), and is arranged to be coaxial or substantially coaxial with the central axis J. For example, a metal, such as iron, which is a magnetic material, is preferably used as a material of the first rotor holder 43. An inner circumferential portion of the first rotor holder 43 is fixed to the upper end portion of the first shaft 41. In addition, a side wall portion of the first rotor holder 43 includes a cylindrical inside surface configured to hold the first rotor magnet 42.

The first impeller 44 is directly or indirectly fixed to an outer circumferential surface of the first rotor holder 43. The first impeller 44 includes a first blade support portion 441 provided in the shape of a cup (or substantially in the shape of a covered cylinder), and a plurality of first blades 442. The first blade support portion 441 is configured to cover at least the outer circumferential surface of the first rotor holder 43. The first blades 442 are arranged in the circumferential direction radially outside of the first blade support portion 441. Each first blade 442 extends radially outward from an outer circumferential surface of the first blade support portion 441. That is, each first blade 442 is supported by the first blade support portion 441. The number of first blades 442 is preferably, for example, five.

The first impeller 44 according to the present preferred embodiment preferably is a resin-molded article. The first blade support portion 441 and the plurality of first blades 442 are preferably integrally defined by a resin injection molding process. Note, however, that the first blade support portion 441 and the plurality of first blades 442 may be defined by separate members.

In the inlet side fan 1, the first shaft 41, the first rotor magnet 42, and the first rotor holder 43 together define a first rotor portion 40, which is a rotating portion. Moreover, the first base portion 31, the first bearing holding portion 32, the first armature 33, and the first bearing member 34, which together define a stationary portion, and the first rotor portion 40 together define a first motor portion 13. In the first motor portion 13, the first rotor portion 40 is located above the first armature 33.

Once the electric drive currents are supplied from the external power supply to the coils 332 of the first armature 33 through the first circuit board 37, magnetic flux is generated around the stator core 331 in accordance with the electric drive currents. Then, interaction between the magnetic flux of the stator core 331 and magnetic flux of the first rotor magnet 42 produces a circumferential torque, so that the first rotor portion 40 is caused to rotate about the central axis J. Once the first rotor portion 40 starts rotating, the first impeller 44 also starts rotating about the central axis J together with the first rotor portion 40. As a result, the air flow F, which passes axially downward, is generated radially inside of the first housing 35. In other words, during rotation, the first impeller 44 generates the air flow F which passes downward from above.

Figure 2:
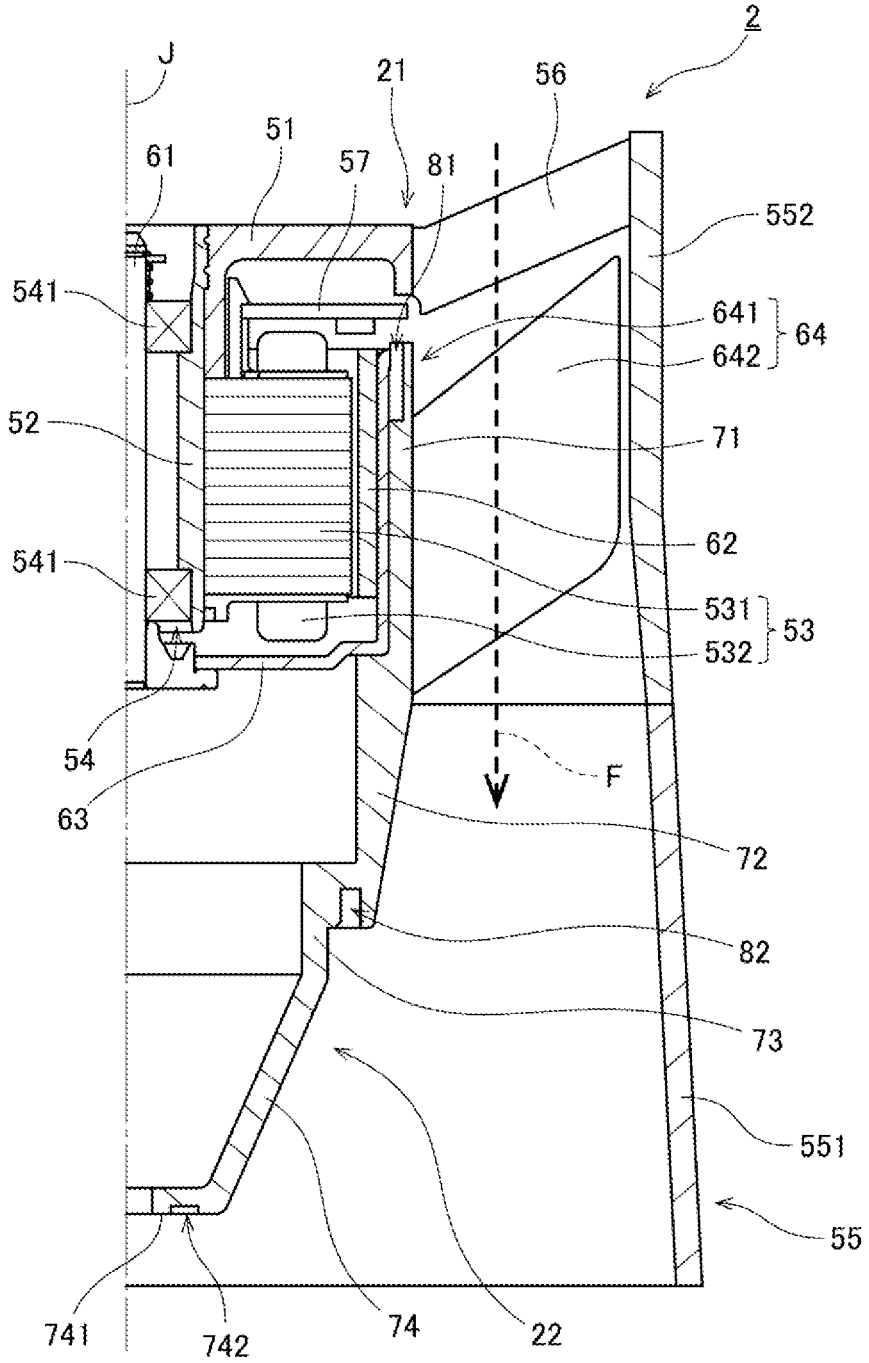
FIG. 2 is a partial vertical cross-sectional view of an outlet side fan according to a preferred embodiment of the present invention.

FIG. 2 is a partial vertical cross-sectional view of the outlet side fan 2. Referring to FIGS. 1 and 2, the outlet side fan 2 preferably includes a second stationary portion 21 and a second rotating portion 22. The second rotating portion 22 is supported to be rotatable with respect to the second stationary portion 21.

The second stationary portion 21 preferably includes the second base portion 51, a second bearing holding portion 52, a second armature 53, a second bearing member 54, a second housing 55, a plurality of second support ribs 56, and a second circuit board 57.

The second base portion 51 is located in the vicinity of the boundary between the inlet side fan 1 and the outlet side fan 2. The upper surface of the second base portion 51 is preferably in contact with the lower surface of the first base portion 31, or is arranged opposite to the lower surface of the first base portion with the slight gap intervening therebetween. The second bearing holding portion 52 extends along the central axis J to assume or substantially assume the shape of a cylinder. An upper end portion of the second bearing holding portion 52 is fixed to the second base portion 51. The second base portion 51 is configured to support the second bearing member 54 and the second armature 53.

The second armature 53 is located radially inside of a second rotor magnet 62 described below. The second armature 53 preferably includes a stator core 531 and a plurality of coils 532. The stator core 531 is preferably defined by, for example, laminated steel sheets, each of which is a magnetic body. The stator core 531 is fixed to an outer circumferential surface of the second bearing holding portion 52. In addition, the stator core 531 includes a plurality of teeth projecting radially outward. A radially outer end surface of each of the teeth is located radially opposite to a radially inner surface of the second rotor magnet 62 described below. Each of the coils 532 is preferably defined by a conducting wire wound around a corresponding one of the teeth.

The second bearing member 54 is accommodated radially inside of the second bearing holding portion 52. A pair of ball bearings 541, for example, are preferably used as the second bearing member 54. The ball bearings 541 are arranged one above the other along the central axis J. An outer race of each ball bearing 541 is fixed to an inner circumferential surface of the second bearing holding portion 52. An inner race of each ball bearing 541 is fixed to a second shaft 61 described below. The second shaft 61 is thus supported to be rotatable with respect to the second bearing holding portion 52.

The second housing 55 extends in the axial direction to assume the shape of a tube radially outside of a second impeller 64 described below. That is, the second housing 55 is provided in an annular shape radially outside of the second impeller 64 to surround the second impeller 64. A space radially inside of the second housing 55 defines a wind channel through which the air flow F passes. A lower opening of the second housing 55 defines an air outlet through which the air is discharged downward.

The second support ribs 56 are located above the second impeller 64 described below. Each of the second support ribs 56 extends in a radial direction to join the second base portion 51 and the second housing 55 to each other. A position of the second armature 53 relative to the second housing 55 is thus fixed. The number of second support ribs 56 is preferably, for example, three. The second base portion 51, the second housing 55, and the second support ribs 56 are preferably, for example, integrally defined portions of a single monolithic member made by a resin injection molding process. Note, however, that some of the second support ribs 56, the second base portion 51, and the second housing 55 may alternatively be defined by separate members if so desired.

The first support ribs 36 and the second support ribs 56 are located axially opposite to each other with a gap intervening therebetween. In other words, the first support ribs 36 and the second support ribs 56 are out of contact with each other. According to the present preferred embodiment, the number of first support ribs 36 and the number of second support ribs 56 are preferably equal to each other. In addition, when the fan assembly 100 is viewed along the central axis J, positions of lower ends of the first support ribs 36 and positions of upper ends of the second support ribs 56 preferably axially overlap with each other. Note, however, that the above relative positions of the first support ribs 36 and the second support ribs 56 are not essential to the present invention.

The second circuit board 57 is located below the second base portion 51 and above the second armature 53. The second circuit board 57 is, for example, fixed to the second armature 53. The second circuit board 57 may be in the shape of either a ring or a circular arc in a plan view. The second circuit board 57 includes an electrical circuit to be electrically connected to the coils 532 of the second armature 53 to supply electric drive currents to the coils 532. This electrical circuit is connected to an external power supply disposed outside of the outlet side fan 2 through a bundle of lead wires. Note that the bundle of lead wires and the external power supply are not shown in the figures.

The second rotating portion 22 preferably includes the second shaft 61, the second rotor magnet 62, a second rotor holder 63, and the second impeller 64.

The second shaft 61 is located radially inside of the second bearing holding portion 52 to be coaxial or substantially coaxial with the central axis J. In other words, the second shaft extends along the central axis J extending in the vertical direction. The second shaft 61 extends upward from a center of a lower portion of the second rotor holder 63 described below. As mentioned above, the second shaft 61 is rotatably supported by the second bearing member 54. An upper end portion of the second shaft 61 is located radially inside of the second base portion 51. A lower end portion of the second shaft 61 projects downward below a lower end portion of the second bearing holding portion 52.

The second rotor magnet 62 is annular, and is located radially outside of the second armature 53. In other words, the second rotor magnet 62 is provided in an annular shape around the central axis J. Note that the second rotor magnet 62 may be defined either by a single cylindrical magnet or by a plurality of magnets provided in an annular shape. The radially inner surface of the second rotor magnet 62 includes north and south poles arranged to alternate with each other in the circumferential direction.

The second rotor holder 63 is provided in the shape of a cup with an axially upward opening (or substantially in the shape of a covered cylinder), and is coaxial or substantially coaxial with the central axis J. For example, a metal, such as iron, which is a magnetic material, is preferably used as a material of the second rotor holder 63. An inner circumferential portion of the second rotor holder 63 is fixed to the lower end portion of the second shaft 61. In addition, a side wall portion of the second rotor holder 63 includes a cylindrical inside surface configured to hold the second rotor magnet 62.

The second impeller 64 is directly or indirectly fixed to an outer circumferential surface of the second rotor holder 63. The second impeller 64 includes a second blade support portion 641 provided in the shape of a cup (or substantially in the shape of a covered cylinder), and a plurality of second blades 642. The second blade support portion 641 is configured to cover at least the outer circumferential surface of the second rotor holder 63. The second blades 642 are arranged in the circumferential direction radially outside of the second blade support portion 641. Each second blade 642 extends radially outward from an outer circumferential surface of the second blade support portion 641. That is, each second blade 642 is supported by the second blade support portion 641. The number of second blades 642 is preferably, for example, five.

The second impeller 64 according to the present preferred embodiment is preferably a resin-molded article. The second blade support portion 641 and the plurality of second blades 642 are integrally defined by a resin injection molding process. Note, however, that the second blade support portion 641 and the plurality of second blades 642 may alternatively be defined by separate members if so desired.

In the outlet side fan 2, the second shaft 61, the second rotor magnet 62, and the second rotor holder 63 together define a second rotor portion 60, which is a rotating portion. Moreover, the second base portion 51, the second bearing holding portion 52, the second armature 53, and the second bearing member 54, which together define a stationary portion, and the second rotor portion 60 together define a second motor portion 23. The second motor portion 23 is preferably substantially similar in structure to the first motor portion 13 except that the second motor portion 23 is turned upside down. In the second motor portion 23, the second armature 53 is located above the second rotor portion 60.

Once the electric drive currents are supplied from the external power supply to the coils 532 of the second armature 53 through the second circuit board 57, magnetic flux is generated around the stator core 531 in accordance with the electric drive currents. Then, interaction between the magnetic flux of the stator core 531 and the magnetic flux of the second rotor magnet 62 produces a circumferential torque, so that the second rotor portion 60 is caused to rotate about the central axis J. Once the second rotor portion 60 starts rotating, the second impeller 64 also starts rotating about the central axis J together with the second rotor portion 60. As a result, the air flow F, which passes axially downward, is generated radially inside of the second housing 55, as indicated by a broken line arrow in FIG. 2. In other words, during rotation, the second impeller 64 generates the air flow F which passes downward from above.

The first housing 35 of the inlet side fan 1 and the second housing 55 of the outlet side fan 2 together define a continuous wind channel extending in the axial direction inside thereof. In the continuous wind channel, the inlet side fan 1 and the outlet side fan 2 are arranged in series in the axial direction. The fan assembly 100 is arranged to rotate the first impeller 44 and the second impeller 64 to generate the axially downward air flow F in the above continuous wind channel. Use of the two impellers 44 and 64 as described above contributes to increasing static pressure of the air flow F.

In addition, the fan assembly 100 according to the present preferred embodiment is preferably a so-called counter-rotating axial fan. That is, the plurality of first blades 442 of the first impeller 44 and the plurality of second blades 642 of the second impeller 64 are slanted in mutually opposite directions. In addition, the first impeller 44 and the second impeller 64 are arranged to rotate in mutually opposite directions while the fan assembly 100 is running. As a result, each of the first impeller 44 and the second impeller 64 generates an axially downward air flow, i.e., the air flow F. When the first impeller 44 and the second impeller 64 are arranged to rotate in opposite directions as described above, straightness of the air flow F is improved. This leads to additional increases in an air volume and static pressure while the fan assembly 100 is running.

Figure 3:
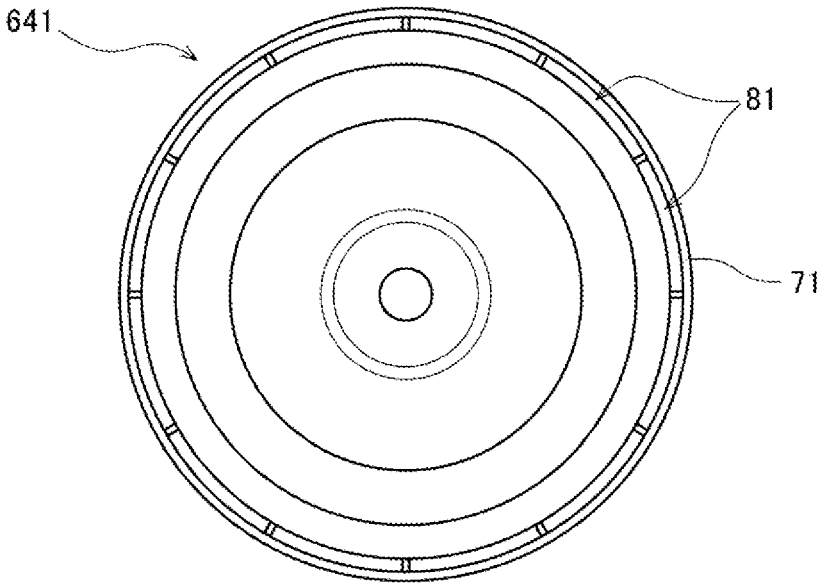
FIG. 3 is a top view of a second blade support portion according to a preferred embodiment of the present invention.
Figure 4:
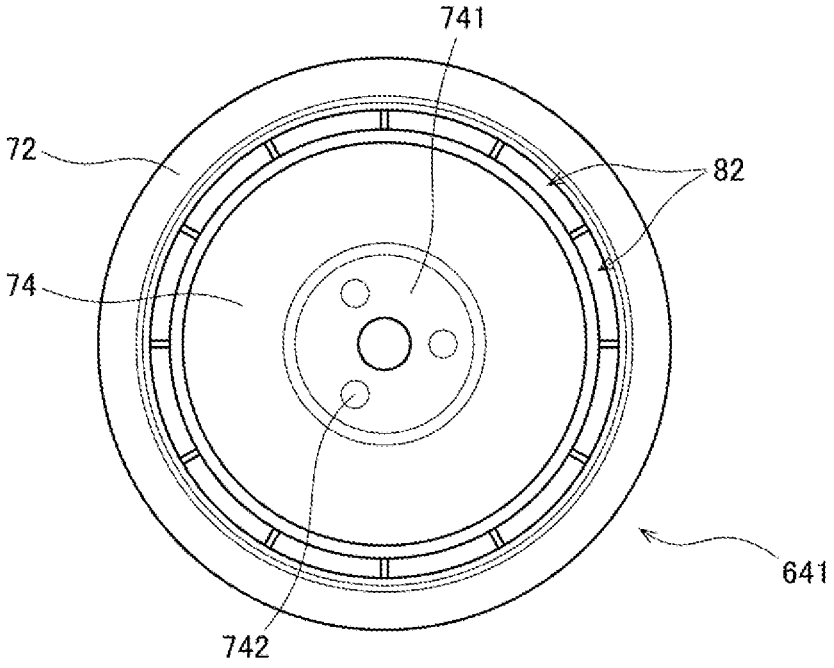
FIG. 4 is a bottom view of the second blade support portion according to a preferred embodiment of the present invention.

Next, the structure of the second impeller 64 included in the outlet side fan 2 will now be described in more detail below. FIG. 3 is a top view of the second blade support portion 641. FIG. 4 is a bottom view of the second blade support portion 641. Referring to FIGS. 2 to 4, the second impeller 64 preferably includes a rotor cover portion 71, a second cone portion 72, a cylindrical portion 73, and a first cone portion 74. More specifically, the second blade support portion 641 of the second impeller 64 includes the rotor cover portion 71, the second cone portion 72, the cylindrical portion 73, and the first cone portion 74.

The rotor cover portion 71 extends in the axial direction to assume the shape of a cylinder, radially outside of a cylindrical side wall of the second rotor holder 63. The outer circumferential surface of the second rotor holder 63 is covered with the rotor cover portion 71 all the way around. A base end portion of each of the plurality of second blades 642 (i.e., a junction of each of the plurality of second blades 642 with the second blade support portion 641) is located at an outer circumferential surface of the rotor cover portion 71.

The second cone portion 72 is preferably a conic portion located below the rotor cover portion 71. The second cone portion 72 is located axially below the base end portion of each of the plurality of second blades 642. An outer circumferential surface of the second cone portion 72 is annular, and gradually decreases in diameter with decreasing height from a lower end of the outer circumferential surface of the rotor cover portion 71. In other words, the second cone portion 72 gradually increases in diameter with increasing height. In more detail, the second cone portion 72 gradually increases in diameter with increasing height axially above a second balance correction portion 82 and axially below a base end portion of the second blade support portion 641.

The cylindrical portion 73 is located below the second cone portion 72 and above the first cone portion 74. An outer circumferential surface of the cylindrical portion 73 extends axially downward from a position slightly radially inside of a lower end of the outer circumferential surface of the second cone portion 72 to assume the shape of a cylinder.

The first cone portion 74 is a conic portion located below the cylindrical portion 73. That is, the first cone portion 74 is located axially below the second balance correction portion 82, which will be described below in greater detail. An outer circumferential surface of the first cone portion 74 is annular, and gradually decreases in diameter with decreasing height from a lower end of the outer circumferential surface of the cylindrical portion 73. In other words, the first cone portion 74 gradually increases in diameter with increasing height.

A first balance correction portion 81 is located between an upper end of the rotor cover portion 71 and an upper end of the side wall of the second rotor holder 63. The first balance correction portion 81 is located between the second blade support portion 641 and the second rotor holder 63, and is configured to allow a change in a circumferential mass distribution. The first balance correction portion 81 is a radial space intervening between the rotor cover portion 71 and the second rotor holder 63. Referring to FIG. 3, the first balance correction portion 81 preferably includes a plurality of hole portions arranged in the circumferential direction. Each hole portion is open axially upwardly. Note, however, that the first balance correction portion 81 may alternatively be a single annular hole portion centered on the central axis J.

In addition, the second balance correction portion 82 is located between a lower end of the outer circumferential surface of the second cone portion 72 and an upper end of the outer circumferential surface of the cylindrical portion 73. The second balance correction portion 82 is located axially below the first balance correction portion 81, and is also located axially below the base end portion of each of the plurality of second blades 642 and the second rotor holder 63. Referring to FIG. 4, the second balance correction portion 82 preferably includes a plurality of hole portions arranged in the circumferential direction. Each hole portion is open axially downwardly. Note, however, that the second balance correction portion 82 may alternatively be a single annular hole portion centered on the central axis J.

During manufacture of the outlet side fan 2, balancing weights, each of which is made of a material having a high specific gravity, are preferably loaded into a circumferential portion of the first balance correction portion 81 and a circumferential portion of the second balance correction portion 82. Thus, circumferential and axial mass distributions of the second rotating portion 22 are adjusted. As a result, dynamic balance of the second motor portion 23 is improved. The first balance correction portion 81 and the second balance correction portion 82 allow adjustment of circumferential and axial mass distributions.

While the fan assembly 100 is running, the axially downward air flow F is generated in the wind channel inside the second housing 55. Air in the vicinity of the base end portion of each second blade 642 flows axially downward along the outer circumferential surface of the second blade support portion 641. If a portion of the air rapidly separates from the second blade support portion 641 at this time, an eddy of air (i.e., turbulence) occurs, leading to an energy loss (i.e., a windage loss). However, in the outlet side fan 2 according to the present preferred embodiment, the second cone portion 72 and the first cone portion 74 are provided, and the second blade support portion 641 gradually decreases in outside diameter. The air flow F passes along the outer circumferential surfaces of the second cone portion 72 and the first cone portion 74. Accordingly, air which has been pushed from the vicinity of the base end portion of each second blade 642 does not rapidly separate from the second blade support portion 641 easily. This contributes to reducing an efficiency reduction due to occurrence of an eddy.

Moreover, the second impeller 64 includes, in addition to the first cone portion 74, the second cone portion 72 located axially above the second balance correction portion 82. As a result, the second impeller 64 includes slanting surfaces whose combined length is greater than a length of a slanting surface in the case where the second cone portion 72 is not provided. This leads to an additional reduction in the likelihood that turbulence will occur. Moreover, an axial distance between the first balance correction portion 81 and the second balance correction portion 82 is greater than in a case where the second cone portion 72 is not provided. This makes it easier to adjust the axial mass distribution of the second rotating portion 22. Accordingly, the dynamic balance of the second motor portion 23 is able to be improved more easily.

The second cone portion 72 and the first cone portion 74 are separate from each other with the second balance correction portion 82 intervening therebetween. Accordingly, the downward air flow F once separates from the second blade support portion 641 between the second cone portion 72 and the first cone portion 74. However, in the second impeller 64, the cylindrical portion 73 is provided between the first cone portion 74 and the second balance correction portion 82. This enables air which has passed a lower end portion of the outer circumferential surface of the second cone portion 72 to smoothly flow along the outer circumferential surface of the first cone portion 74. This in turn reduces the likelihood that an eddy will occur in the vicinity of a boundary between the second cone portion 72 and the first cone portion 74.

The first cone portion 74 includes a bottom surface 741. The bottom surface 741 of the first cone portion 74 is a lower end surface of the second blade support portion 641. Referring to FIG. 4, the bottom surface 741 of the first cone portion 74 is circular in a plan view. The second impeller 64 includes, in the bottom surface 741 of the first cone portion 74, a gate mark 742, which is a mark of a hole through which a resin is injected at the time of the injection molding process. Arranging the gate mark 742 in the bottom surface 741 of the first cone portion 74 reduces the likelihood that the gate mark 742 will cause turbulence in the air flow F.

The second housing 55 is preferably defined by two members: a lower housing member 551 and an upper housing member 552 located axially above the lower housing member 551. The lower housing member 551 radially overlaps with the first cone portion 74. The upper housing member 552 radially overlaps with the plurality of second blades 642.

A lower end of the lower housing member 551 is positioned at an axial level lower than an axial level of a lower end of the first cone portion 74. This contributes to preventing gas which has passed a surface of the first cone portion 74 from rapidly diffusing radially outward. In addition, an inner circumferential surface of the lower housing member 551 is arranged around the first cone portion 74, and is arranged to gradually increase in diameter with decreasing height. That is, the inner circumferential surface of the lower housing member 551 becomes gradually more distant from the central axis J with decreasing distance from the air outlet. As a result, the lower housing member 551, which is an exhaust pipe portion, functions as a diffuser to allow the air flow F to diffuse gradually. In other words, the lower housing member 551 includes, around the first cone portion 74, an exhaust pipe portion an inner circumferential surface of which increases in diameter with decreasing height.

Here, while passing inside the first housing 35 and the second housing 55, the air flow F has a high flow velocity because an air channel inside the first housing 35 and the second housing 55 has a smaller width than that of an air channel outside of the first and second housings 35 and 55. This is because the first housing 35 and the second housing 55 together have structures similar to that of those in a venturi mechanism. Meanwhile, immediately after the air flow F is discharged through the air outlet at a lower end of the second housing 55, the air channel for the air flow F abruptly increases in width, causing the air flow F to diffuse radially away from the central axis J. If a drastic change in a cross-sectional area of the air channel occurs, an eddy tends to easily occur because of a rapid diffusion of the air flow F.

In the fan assembly 100, as described above, a wind channel defined between the lower housing member 551 and a combination of the second cone portion 72 and the first cone portion 74 gradually extends both radially inward and radially outward with decreasing height. As a result, the area of an air channel inside of the second housing 55 gradually increases with decreasing distance from the air outlet. This contributes to reducing the extent of a rapid diffusion of air. This in turn contributes to reducing the likelihood that an eddy will occur, and also contributes to further reducing the windage loss.

Notice that, below the air outlet of the second housing 55, a radially outward extension of a space is extremely great. Therefore, even if the lower end of the first cone portion 74 were arranged to project downward below the lower end of the lower housing member 551, an effect of gradually increasing the area of the air channel as produced by the first cone portion 74 would be minimal below the air outlet. Meanwhile, when the lower end of the lower housing member 551 is positioned at an axial level lower than an axial level of the lower end of the first cone portion 74 as described above, an effect of gradually increasing the area of the air channel is easily produced by the lower housing member 551 and the first cone portion 74. Accordingly, an occurrence of an eddy in the air flow F, which is discharged through the air outlet of the second housing 55, is more effectively prevented.

When an unbalance has occurred in a mass distribution of a rotating body around a rotation axis, a weight is attached to a position 180° away from a displaced center of gravity around the rotation axis, or a minus balancing operation (i.e., a cutting of a portion of the rotating body) is performed at the displaced center of gravity, to correct the unbalance. A rotating body having a large axial dimension can be assumed to be a structure defined by a plurality of disks placed one upon another in the axial direction. Even when such a rotating body having a large axial dimension has no unbalance as a whole, the disks may have unbalances uncorrected. Thus, unbalances of disks axially away from each other may interact to cause a moment with respect to the rotation axis, easily causing vibrations or noise during rotation.

In the outlet side fan 2, the second rotating portion 22 has a large axial dimension as the second blade support portion 641 includes slanting surfaces, i.e., the outer circumferential surfaces of the first cone portion 74 and the second cone portion 72. Accordingly, in order to solve the problem of the unbalances as explained in the previous paragraph, the first balance correction portion 81 and the second balance correction portion 82 are provided in the second rotating portion 22. When the first balance correction portion 81 and the second balance correction portion 82 are provided, corrections of the mass distribution are able to be performed at two positions of the second rotating portion 22 which are axially away from each other. This provides an improvement in the dynamic balance (i.e., two-plane balance) of the second rotating portion 22.

In particular, according to the present preferred embodiment, the rotor cover portion 71 and the second cone portion 72 are located between the first balance correction portion 81 and the second balance correction portion 82. This causes the first balance correction portion 81 and the second balance correction portion 82 to be located farther axially away from each other. This provides a further improvement in the dynamic balance of the second rotating portion 22.

The first balance correction portion 81 is located radially inside of the second blade support portion 641. This prevents the first balance correction portion 81 from easily affecting a path through which air passes. This in turn contributes to reducing the likelihood that a loss of the air flow F will occur due to the first balance correction portion 81. On the other hand, it is difficult to position the second balance correction portion 82 radially inside of the second blade support portion 641 because a lower portion of the second blade support portion 641 is closed. Even if the second balance correction portion 82 were located radially inside of the second blade support portion 641 in the vicinity of the lower portion of the second blade support portion 641, the second rotor holder 63 would make an operation of adding a balancing weight difficult.

Accordingly, in the outlet side fan 2, the second balance correction portion 82 is located radially inward of an annular imaginary plane which is an axially downward extension of the outer circumferential surface of the second cone portion 72. In addition, each of the plurality of hole portions included in the second balance correction portion 82 is open axially downwardly. Accordingly, the second balance correction portion 82 also does not easily affect the path through which the air passes. Thus, the likelihood that a loss of the air flow F will occur due to the second balance correction portion 82 is also reduced.

Figure 5:
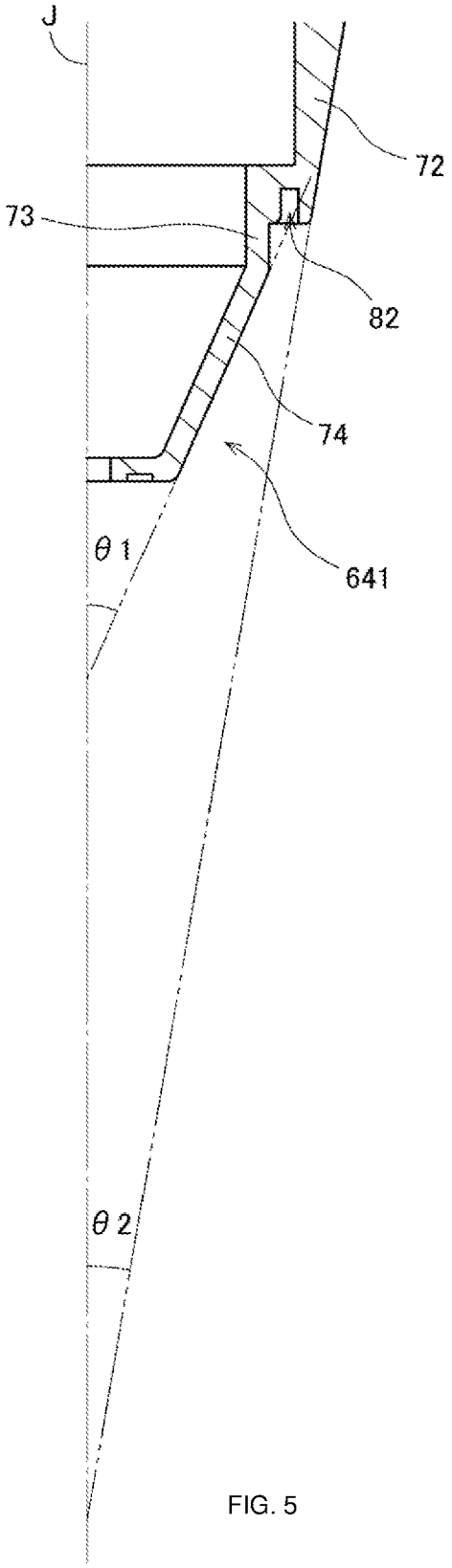
FIG. 5 is a partial vertical cross-sectional view of the second blade support portion according to a preferred embodiment of the present invention.

FIG. 5 is a partial vertical cross-sectional view of the second blade support portion 641. Referring to FIG. 5, an average angle of inclination of a straight line that joins an upper end edge and a lower end edge of the first cone portion 74 with respect to the central axis J is denoted as θ1. In addition, an average angle of inclination of a straight line that joins an upper end edge and a lower end edge of the second cone portion 72 with respect to the central axis J is denoted as θ2. Each of the average angles of inclination θ1 and θ2 refers to an acute angle smaller than 90 degrees. In the preferred embodiment illustrated in FIG. 5, 61 is greater than 62. The above arrangement allows the air flow F, which passes the outer circumferential surface of the second cone portion 72 and the outer circumferential surface of the first cone portion 74, to gently separate from the surface of each of the first and second cone portions 74 and 72. This leads to an additional reduction in the likelihood that turbulence will occur.

The air flow F caused by rotation of the second impeller 64 is fastest immediately after being accelerated by the plurality of second blades 642, and becomes gradually slower as it travels axially downward away from the second blades 642. Accordingly, the air flow F has a lower flow velocity when passing the outer circumferential surface of the first cone portion 74 than when passing the outer circumferential surface of the second cone portion 72. The air flow F separates from the outer circumferential surface of the second blade support portion 641 more easily when having a higher flow velocity than when having a lower flow velocity. If a separation of the air flow F occurs, a Kärmän vortex street is generated to transform energy of the air flow F into vortices, resulting in an energy loss. Accordingly, in the preferred embodiment illustrated in FIG. 5, the average angle of inclination θ2 of the second cone portion 72 with respect to the central axis J is smaller than the average angle of inclination θ1 of the first cone portion 74 with respect to the central axis J. This reduces the likelihood that a separation of the air flow F will occur in the vicinity of the outer circumferential surface of the second cone portion 72. This makes it possible to generate the air flow F while reducing the likelihood that a separation of the air flow F will occur as the air flow F passes the outer circumferential surface of the second cone portion 72 and the outer circumferential surface of the first cone portion 74.

In addition, referring to FIG. 5, in a section of the outlet side fan 2 taken along a plane including the central axis J, a tangent to a radially outer surface of the first cone portion 74 at the upper end edge of the first cone portion 74 crosses the second balance correction portion 82. In this case, an angle defined between the inclined outer circumferential surface of the first cone portion 74 and a direction of the air flow F when the air flow F has passed the outer circumferential surface of the second cone portion 72 is smaller than in the case where the above tangent does not cross the second balance correction portion 82. This makes it easier for air which has passed the surface of the second cone portion 72 to flow along the surface of the first cone portion 74 after leaving the second cone portion 72. This leads to an additional reduction in the likelihood that an eddy will be generated in the air flow F.

The above-described structure of the fan assembly 100 according to the present preferred embodiment makes it possible to reduce the likelihood that an eddy will occur while increasing the static pressure of the air flow F, and improve the dynamic balance, thus reducing vibrations and noise. In particular, to air-cool a server room in which a plurality of electronic devices are installed, a high static pressure and reduced vibration are demanded. Therefore, the structure of the fan assembly 100 according to the present preferred embodiment is suitable for the above purpose.

While preferred embodiments of the present invention have been described above, it is to be understood that the present invention is not limited to the above-described preferred embodiments.

A three-phase brushless motor, for example, may be used as each of the first motor portion 13 included in the inlet side fan 1 and the second motor portion 23 included in the outlet side fan 2. Note, however, that other motors, such as a single-phase or two-phase brushless motor may be used instead of the three-phase brushless motor. Also note that a brushed motor including a brush and a commutator may be used instead of the brushless motor. Also note that a motor of another type, such as, for example, a stepping motor, may alternatively be used.

Also note that, although the counter-rotating axial fan including the inlet side fan 1 and the outlet side fan 2 and in which a rotation direction of the first impeller 44 of the inlet side fan 1 and a rotation direction of the second impeller 64 of the outlet side fan 2 are different from each other has been described above as a preferred embodiment of the present invention, an axial fan according to another preferred embodiment of the present invention may include only one fan.

Also note that details of the shape of an axial fan according to a preferred embodiment of the present invention may differ from details of the shape of each axial fan as illustrated in the accompanying drawings of the present application. Also note that features of the above-described preferred embodiments and the modifications thereof may be combined appropriately as long as no conflict arises.

Preferred embodiments of the present invention are applicable to, for example, axial fans and fan assemblies.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An axial fan comprising:

a stationary portion; and a rotating portion supported to be rotatable with respect to the stationary portion; wherein the rotating portion includes:

a shaft positioned along a central axis extending from an inlet of the axial fan to an outlet of the axial fan;

a rotor magnet provided in an annular shape around the central axis;

a rotor holder including a cylindrical inside surface configured to hold the rotor magnet; and an impeller directly or indirectly fixed to an outer circumferential surface of the rotor holder;

the stationary portion includes:

an armature located radially inside of the rotor magnet;

a bearing member configured to rotatably support the shaft;

a base portion configured to support the bearing member and the armature;

a tubular housing extending in an axial direction radially outside of the impeller;

and a plurality of support ribs, each of which is configured to join the housing and the base portion to each other, the plurality of support ribs is located upstream of the impeller in the axial direction;

the impeller includes:

a cup-shaped blade support portion configured to cover the rotor holder; and a plurality of blades arranged in a circumferential direction radially outside of the blade support portion to generate a downward air flow, downward being from the inlet of the axial fan to the outlet of the axial fan, in the axial direction during rotation;

the rotating portion includes a first balance correction portion located between the blade support portion and the rotor holder in the radial direction, and configured to allow a change in a circumferential mass distribution; and the impeller includes:

a second balance correction portion which is: located below the first balance correction portion in the axial direction, located below the rotor holder and a junction of each blade with the blade support portion in the axial direction, and configured to allow a change in a circumferential mass distribution;

a first cone portion located below the second balance correction portion in the axial direction and decreasing in diameter with a height decreasing downward in the axial direction; and a tangent to a radially outer surface of the first cone portion crosses the second balance correction portion.

2. The axial fan according to claim 1, wherein the impeller further includes a second cone portion increasing in diameter with increasing height in the axial direction which is located above the second balance correction portion and below the junction of each blade with the blade support portion in the axial direction.

3. The axial fan according to claim 2, wherein an angle of inclination of a straight line that joins an upper end edge and a lower end edge of the first cone portion with respect to the central axis is greater than an angle of inclination of a straight line that joins an upper end edge and a lower end edge of the second cone portion with respect to the central axis.

4. The axial fan according to claim 1, wherein the impeller includes a cylindrical portion including a cylindrical outer circumferential surface and located between the first cone portion and the second balance correction portion.

5. The axial fan according to claim 1, wherein the second balance correction portion includes a plurality of hole portions arranged in the circumferential direction; and each of the plurality of hole portions is open downwardly in the axial direction.

6. The axial fan according to claim 1, wherein a lower end of the housing is positioned at a level lower than a level of a lower end of the first cone portion in the axial direction.

7. The axial fan according to claim 1, wherein the housing includes, circumferentially around the first cone portion, an exhaust pipe portion including an inner circumferential surface increasing in diameter with decreasing height in the axial direction.

8. The axial fan according to claim 1, wherein the housing includes:

a lower housing member which radially overlaps with the first cone portion; and an upper housing member which radially overlaps with the blades.

9. The axial fan according to claim 1, wherein the impeller is a resin-molded article;

the first cone portion includes a bottom surface in the axial direction that is circular in a plan view; and the first cone portion includes a gate mark in the bottom surface.

10. A fan assembly comprising:

an outlet side fan which is the axial fan according to claim 1; and an inlet side fan which is an axial fan located above the outlet side fan in the axial direction; wherein a housing of the inlet side fan and the housing of the outlet side fan together define a continuous wind channel.

11. The fan assembly according to claim 10, wherein a rotation direction of an impeller of the inlet side fan and a rotation direction of the impeller of the outlet side fan are different from each other.

12. The fan assembly according to claim 10, wherein the fan assembly is configured to supply a cooling air flow to an interior of a room in which a plurality of electronic devices are installed.

13. The axial fan of claim 1, further comprising:

an inlet above the plurality of support ribs in the axial direction; and an outlet below the cone portion in the axial direction.

* * * * *